US007979007B2

(12) United States Patent
Mihara et al.

(10) Patent No.: US 7,979,007 B2
(45) Date of Patent: Jul. 12, 2011

(54) DEVELOPING DEVICE AND IMAGE FORMING APPARATUS USING THE SAME

(75) Inventors: Koichi Mihara, Osaka (JP); Toshihide Ohgoshi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/697,527

(22) Filed: Feb. 1, 2010

(65) Prior Publication Data

US 2010/0196057 A1 Aug. 5, 2010

(30) Foreign Application Priority Data

Feb. 2, 2009 (JP) ..... 2009-021450
Feb. 27, 2009 (JP) ..... 2009-046112

(51) Int. Cl.
*G03G 15/08* (2006.01)

(52) U.S. Cl. ..... 399/254; 366/295; 399/256

(58) Field of Classification Search ..... 399/256, 399/254, 258, 263; 366/241, 279, 292, 293, 366/295, 318, 323
See application file for complete search history.

(56) References Cited

U.S. PATENT DOCUMENTS

| | | | | |
|---|---|---|---|---|
| 4,634,286 | A | 1/1987 | Pike | 366/320 |
| 6,577,834 | B2 | 6/2003 | Suzuki | 399/254 |
| 7,311,438 | B2 * | 12/2007 | Kim et al. | 366/295 |
| 7,426,361 | B2 * | 9/2008 | Thompson et al. | 399/254 |
| 7,817,943 | B2 * | 10/2010 | Utsumi et al. | 399/254 |
| 2008/0226349 | A1 * | 9/2008 | Iwata et al. | 399/239 |
| 2010/0196058 | A1 * | 8/2010 | Mihara et al. | 399/256 |

FOREIGN PATENT DOCUMENTS

| | | |
|---|---|---|
| JP | 58-219575 | 12/1983 |
| JP | 62-71983 | 4/1987 |
| JP | 2005-024592 A | 1/2005 |
| JP | 2008-032983 | 2/2008 |
| JP | 2008-216845 A | 9/2008 |

* cited by examiner

*Primary Examiner* — Sophia S Chen
(74) *Attorney, Agent, or Firm* — Nixon & Vanderhye, PC

(57) ABSTRACT

A developing device includes a developing vessel for storing a developer, a first conveying passage, a second conveying passage, a first conveying member, a second conveying member and a developing roller for supplying toner to a photoreceptor drum. The first conveying member has a first rotary shaft and a first conveying blade formed on the periphery of the first rotary shaft. The first conveying blade has a large-diametric ring-shaped helical blade and a small-diametric helical blade, forming a double-helical structure. Alternatively, the first conveying blade is formed of helical blades being different in phase; each helical blade is formed so that the radius varies on a cycle of the rotational angle of 180 degrees.

11 Claims, 11 Drawing Sheets

DEVELOPING DEVICE AND IMAGE FORMING APPARATUS USING THE SAME

This Nonprovisional application claims priority under 35 U.S.C. .sctn.119 (a) on Patent Application No. 2009-021450 filed in Japan on 2 Feb. 2009 and Patent Application No. 2009-046112 filed in Japan on 27 Feb. 2009, the entire contents of which are hereby incorporated by reference.

BACKGROUND OF THE TECHNOLOGY

1. Field of the Technology

The technology relates to a developing device and an image forming apparatus using the device, in particular relating to a developing device using a dual-component developer containing a toner and a magnetic carrier, for use in an image forming apparatus for forming images using the toner based on electrophotography, such as an electrostatic copier, laser printer, facsimile machine or the like, as well as to an image forming apparatus using this device.

2. Description of the Prior Art

Conventionally, image forming apparatuses based on electrophotography such as copiers, printers, facsimile machines and the like have been known. The image forming apparatus using electrophotography is constructed so as to form an image by forming an electrostatic latent image on the photoreceptor drum (toner image bearer) surface, supplying toner to the photoreceptor drum from a developing device to develop the electrostatic latent image, transferring the toner image formed on photoreceptor drum by development to a sheet of paper or the like, and fixing the toner image onto the sheet by means of a fixing device.

Recently, in the image forming apparatuses capable of reproducing full-color and high-quality images, a dual-component developer (which will be referred to hereinbelow as simply "developer"), which can present excellent charge performance stability, is often used. This developer consists of a toner and a carrier, which are agitated in the developing device and frictionally rubbed with each other to produce appropriately electrified toner.

In the developing device, the electrified toner is supplied to a developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Further, the image forming apparatus of this kind is demanded to be made compact and operate at high speed, and it is also necessary to electrify the developer quickly and sufficiently and also convey the developer quickly and smoothly.

For this purpose, in order to disperse supplied toner promptly into the developer and provide the toner with an appropriate amount of charge, an image forming apparatus equipped with a developing device of a circulating mechanism including two developer conveying passages that form a circulative path for conveying the developer and two developer agitators that agitate the developer while conveying the developer in the developer passages has been disclosed in patent document 1 (see Japanese Patent Application Laid-open 2005-24592).

In the developing device of patent document 1, usually, auger screws are used as the conveying members for circulatively conveying the developer while agitating the developer inside the developer vessel. However, this configuration has suffered the problem that if the helical pitch of the auger screw is made greater or the rotational speed of the augers is increased in order to raise the speed of developer conveyance, the pressure acting from the helical blade on the developer becomes higher, causing stress on the developer and hence lowering developer fluidity seriously.

Further, if, in order to reduce the pressure on the developer, a multi-bladed screw structure (such as a double helical structure, triple helical structure and any other structures) is adopted, agitation of the developer in the axial direction of the auger screw is hindered by the helical blades. As a result, this configuration has suffered the problem that variation in toner concentration across the length of the auger screw cannot be leveled off, causing toner density unevenness.

Further, when a conveying member provided with a plurality of discrete agitating blades is used in order to enhance agitation performance of the developer, this configuration has suffered the problem that the flow of the developer is made unstable, causing stress on the developer and hence markedly lowering developer fluidity.

SUMMARY OF THE TECHNOLOGY

The technology has been devised in view of the above problems, it is therefore an object to provide a developing device that is excellent in agitating the developer without excessively raising stress on the developer as well as providing an image forming apparatus using this device.

According to the technology, the developing device for solving the above problems and the image forming apparatus using this are configured as follows:

The developing device includes: a developer container for accommodating a developer comprising a toner and a magnetic carrier; a developer conveying passage through which the developer is conveyed in the developer container; a developer conveying member disposed inside the developer conveying passage for agitating and conveying the developer in a predetermined direction; and, a developing roller which bears the developer in the developer conveying passage and, supplies the toner contained in the developer to a photoreceptor drum. In this developing device, the developer conveying member includes: a rotary shaft and multi helical blades formed, on the periphery of the rotary shaft, the multi helical blades include one or more ring-shaped helical blades and one or more small-diametric helical blades, the small-diametric helical blade has a second outside diameter smaller than the first outside diameter of the ring-shaped helical blade, and the helical pitch of the ring-shaped helical blade is the same as the helical pitch of the small-diametric helical blade.

According to the developing device of the second aspect, it is preferable that the multi helical blades form a double helical structure including two blades, one being the ring-shaped helical blade and the other the small-diametric blade.

According to the developing device of the third aspect, it is preferable that the second outside diameter is set to fall within the range of 0.4 times to 0.6 times of the first outside diameter.

According to the developing device of the fourth aspect, the ring-shaped helical blade and the small-diametric helical blade are arranged so as to have a phase difference of 180 degrees with each other.

The image forming apparatus according to the fifth aspect is an image forming apparatus for forming images with toner based on electrophotography, comprising: a photoreceptor drum for forming an electrostatic latent image on the surface thereof; a charging device for electrifying the surface of the photoreceptor drum; an exposure device for forming the electrostatic latent image on the photoreceptor drum surface; a developing device for forming a toner image by supplying toner to the electrostatic latent image on the photoreceptor drum surface; a transfer device for transferring the toner image to a recording medium; and, a fixing device for fixing the transferred toner image to the recording medium, wherein the developing device employs any one of the developing devices defined in the above first to fourth aspects.

According to the developing device of the sixth aspect, includes: a developer container for accommodating a developer comprising a toner and a magnetic carrier; a developer conveying passage through which the developer is conveyed in the developer container; a developer conveying member disposed inside the developer conveying passage for agitating and conveying the developer in a predetermined direction; and, a developing roller which bears the developer in the developer conveying passage and supplies the toner contained in the developer to a photoreceptor drum. In this developing device, the developer conveying member is an auger screw including a rotary shaft and a plurality of helical blades formed on the periphery of the rotary shaft, and the helical, blade periodically varies in radius.

Here, the radius of the helical blade indicates the distance from the center of the rotary shaft of the developer conveying member to the leading edge (outer periphery) of the helical blade extending in the radial direction of the rotary shaft. That is, the radius corresponds to a half of the outside diameter of the helical blade.

According to the developing device of the seventh aspect, it is preferable that the plural helical blades all have the same helical pitch.

According to the developing device of the eighth aspect, it is preferable that the plural helical blades comprise two helical blades, the two helical blades are each formed so that the radius periodically varies on a cycle of the rotational angle of 180 degrees, and, the two helical blades are formed so as to have a phase difference of 90 degrees.

According to the developing device of the ninth aspect, it is preferable that the plural helical blades comprise three helical blades, the three helical blades are each formed so that the radius periodically varies on a cycle of the rotational angle of 180 degrees, and, the three helical blades are formed so as to have a phase difference of 60 degrees from each other.

According to the developing device of the tenth aspect, it is preferable that the helical blade is formed so that the minimum radius falls within the range of 40% to 60% of the maximum radius.

The image forming apparatus according to the eleventh aspect is an image forming apparatus for forming images with toner based on electrophotography, comprising: a photoreceptor drum for forming an electrostatic latent image on the surface thereof; a charging device for electrifying the surface of the photoreceptor drum; an exposure device for forming the electrostatic latent image on the photoreceptor drum surface; a developing device for forming a toner image by supplying toner to the electrostatic latent image on the photoreceptor drum surface; a transfer device for transferring the toner image to a recording medium; and, a fixing device for fixing the transferred toner image to the recording medium, wherein the developing device employs any one of the developing devices defined in the above sixth to tenth aspects.

According to the first aspect, since the interval between the helical blades can be shortened so as to enlarge the surface area of the helical blade in contact with the developer, it is possible to reduce the force (pressure) acting on the developer and hence alleviate stress on the developer. Further, since the developer in the vicinity of the large-diametric ring-shaped helical blade is conveyed at high speed in the area distant from the rotary shaft and at low speed in the area near the rotary shaft while the developer in the vicinity of the small-diametric helical blade is conveyed at low speed in the area distant from the rotary shaft and at high speed in the area near the rotary shaft, agitation of the developer can be promoted. Further, since the helical pitch of the ring-shaped helical blade is specified to be the same as the helical pitch of the small-diametric helical blade, the intervals between helical blades are made uniform over the whole range of the developer conveying member with respect to the developer's direction of conveyance, it is hence possible to convey the developer in a stable manner.

As a result, it is possible to improve agitation of the developer with respect to the axial direction of the rotary axis (developer's direction of conveyance), and it is possible to reduce toner concentration unevenness.

Also, when the developer is conveyed by the developer conveying member, the developer is conveyed at lower speed in the area (near the interior wall of the developer container) that is away from the rotary shaft of the developer conveying member due to friction between the developer and the interior wall of the developer conveying passage whereas the developer is conveyed at high speed in the area near the rotary shaft of the developer conveying member. As a result, local eddies of the developer are formed. According to the first aspect, since small-diametric helical blades having a smaller outside diameter are formed between large-diametric ring-shaped helical blades with respect to the rotational axial direction of the developer conveying member, it is possible to alleviate hindrance against swirling flow of the developer occurring between ring-shaped helical blades, and improve agitation performance of the developer.

According to the second aspect, it is possible to convey the developer in a stable manner while efficiently agitating the developer.

According to the third aspect, both agitation performance and conveyance performance of the individual helical blades can be made compatible. If the second outside diameter is less than 0.4 times of the first outside diameter, conveying performance of the developer lowers and a turbulent flow is prone to occur. In contrast, if the second outside diameter exceeds 0.6 times of the first outside diameter, a density variation of the developer tends to occur.

According to the fourth aspect, the turns of the ring-shaped helical blade having the larger outside diameter and the turns of the small-diametric helical blade having the smaller outside diameter are arranged at intervals of the same distance. That is, the interval between the adjacent turns of the two helical blades is constant. As a result, the conveying speed of the developer is stabilized and pressure unevenness is unlikely to occur.

According to the fifth aspect, since it is possible to alleviate stress on the developer without spoiling agitation performance of the developer, it is possible to reduce image density unevenness due to image density failure or toner concentration unevenness.

According to the sixth aspect, since the interval between the helical blades can be shortened so as to enlarge the surface area of the helical blade in contact with the developer, it is possible to reduce the force (pressure) acting on the developer during rotation of the auger screw, and hence alleviate stress on the developer. Further, since the developer is efficiently moved (agitated) in the developer's direction of conveyance, passing over the portions where the radius of the helical blade is short, it is possible to improve agitation performance of the developer with respect to the axial direction of the auger screw and hence reduce toner concentration unevenness.

According to the seventh aspect, since the intervals between turns of helical blades are made uniform across the whole range along the axial direction of the auger screw, it is possible to realize stable conveyance of the developer.

According to the eighth aspect, since the maximum-diametric parts of one helical blade and the minimum-diametric parts of the other helical blade are arranged alternately in the axial direction of the auger screw, unevenness in pressure and amount of the developer is unlikely to occur along the axial direction of the auger screw, hence it is possible to realize smooth conveyance of the developer.

According to the ninth aspect, since the maximum-diametric parts of one helical blade and the medium-diametric parts of the other two helical blades are arranged alternately in the axial direction of the auger screw, compression unevenness is unlikely to occur along the axial direction of the auger screw, hence it is possible to realize smooth conveyance of the developer.

According to the tenth aspect, both developer agitation performance and conveyance performance can be made compatible.

According to the eleventh aspect, since it is possible to alleviate stress on the developer without reducing agitation performance of the developer, it is possible to reduce image density unevenness due to image density failure and toner concentration unevenness.

DESCRIPTION OF THE PREFERRED EMBODIMENTS

The First Embodiment

Now, the embodied modes for carrying out the technology will be described with reference to the drawings.

Figure 1:
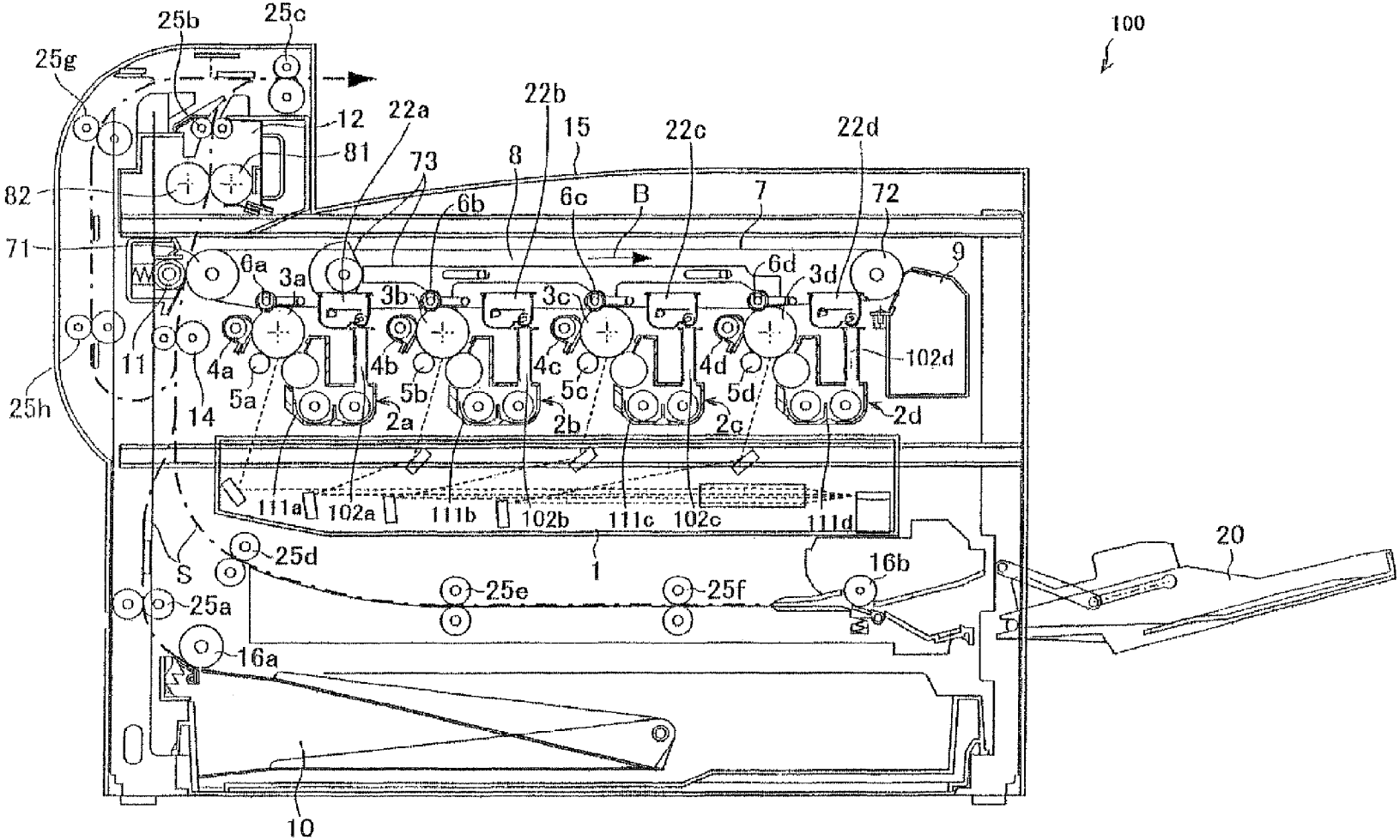
FIG. 1 is an illustrative view showing the overall configuration of an image forming apparatus in which developing devices according to the first to third embodiments are used.

FIG. 1 shows one exemplary embodiment, and is an illustrative view showing the overall configuration of an image forming apparatus in which developing devices according to the first to third embodiments are used.

An image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surface thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2, 2X or 2Y" when general mention is made) for supplying toners to the electrostatic latent images on the photoreceptor drum 3 surfaces to form toner images; toner supply devices 22*a*, 22*b*, 22*c* and 22*d* (which may be also called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimpose these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system S and a paper feed tray 10 and a paper output tray 15.

Charger 5 electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 visualizes (develops) the electrostatic latent image formed on photoreceptor drum 3 with toner of K, C, M or Y. Arranged over developing devices 2 (2*a*, 2*b*, 2*c* and 2*d*) are toner transport mechanisms 102*a*, 102*b*, 102*c* and 102*d* (which may also be called "toner transport mechanisms 102 when general mention is made), toner supply devices 22 (22*a*, 22*b*, 22*c* and 22*d*) and developing vessels (developer container) 111*a*, 111*b*, 111*c* and 111*d* (which may also be called "developer vessels 111 when general mention is made).

Toner supply device 22 is arranged on the upper side of developing vessel 111 and stores unused toner (powder toner). This unused toner in toner supply device 22 is supplied to developing vessel 111 by means of toner transport mechanism 102.

Cleaner unit 4 removes and collects the toner remaining on the photoreceptor drum 3 surface after development and image transfer steps.

Arranged over photoreceptor drums 3 are an intermediate transfer belt unit 8. Intermediate transfer belt unit 8 includes intermediate transfer rollers 6*a*, 6*b*, 6*c* and 6*d* (which may also be called "intermediate transfer rollers 6 when general mention is made), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multicolor toner image). This intermediate transfer belt 7 is formed of an endless film of about 100 to 150 .mu.m thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is moved by rotation of intermediate transfer belt to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes in contact with photoreceptor drums 3, the toner which has not been transferred from intermediate transfer belt 7 to the paper during transfer of the toner image and remains on intermediate transfer belt 7 would cause contamination of color toners at the next operation, hence is removed and collected by an intermediate transfer belt cleaning unit 9.

Intermediate transfer belt cleaning unit 9 includes a cleaning blade (cleaning member) that comes into contact with intermediate transfer belt 7. Intermediate transfer belt 7 is supported from its interior side by intermediate transfer belt driven roller 72, at the area where this cleaning blade comes into contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the side of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end, of the image area on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a controller (not shown) so as to keep a predetermined fixing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color Loner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including a lamination of toner images on intermediate transfer belt 7. At the transfer portion, the toner image is transferred onto the sheet. Then, this toner image is fixed onto the sheet by fixing unit 12.

Thereafter, the sheet passes through feed roller 25*b* to be discharged by paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 of the present embodiment will be specifically described.

Figure 2:
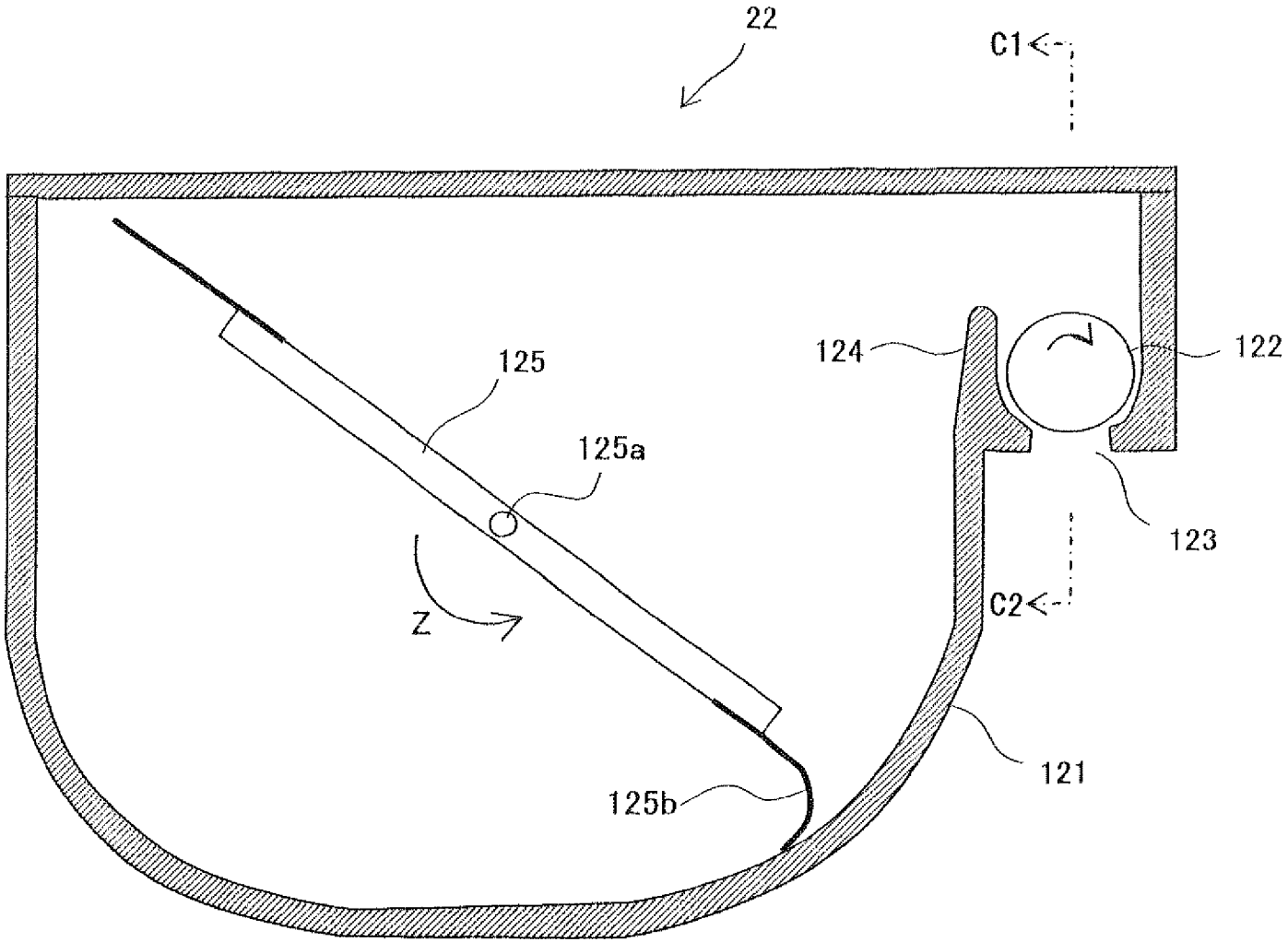
FIG. 2 is a sectional view showing the schematic configuration of a toner supply device that constitutes the image forming apparatus.
Figure 3:
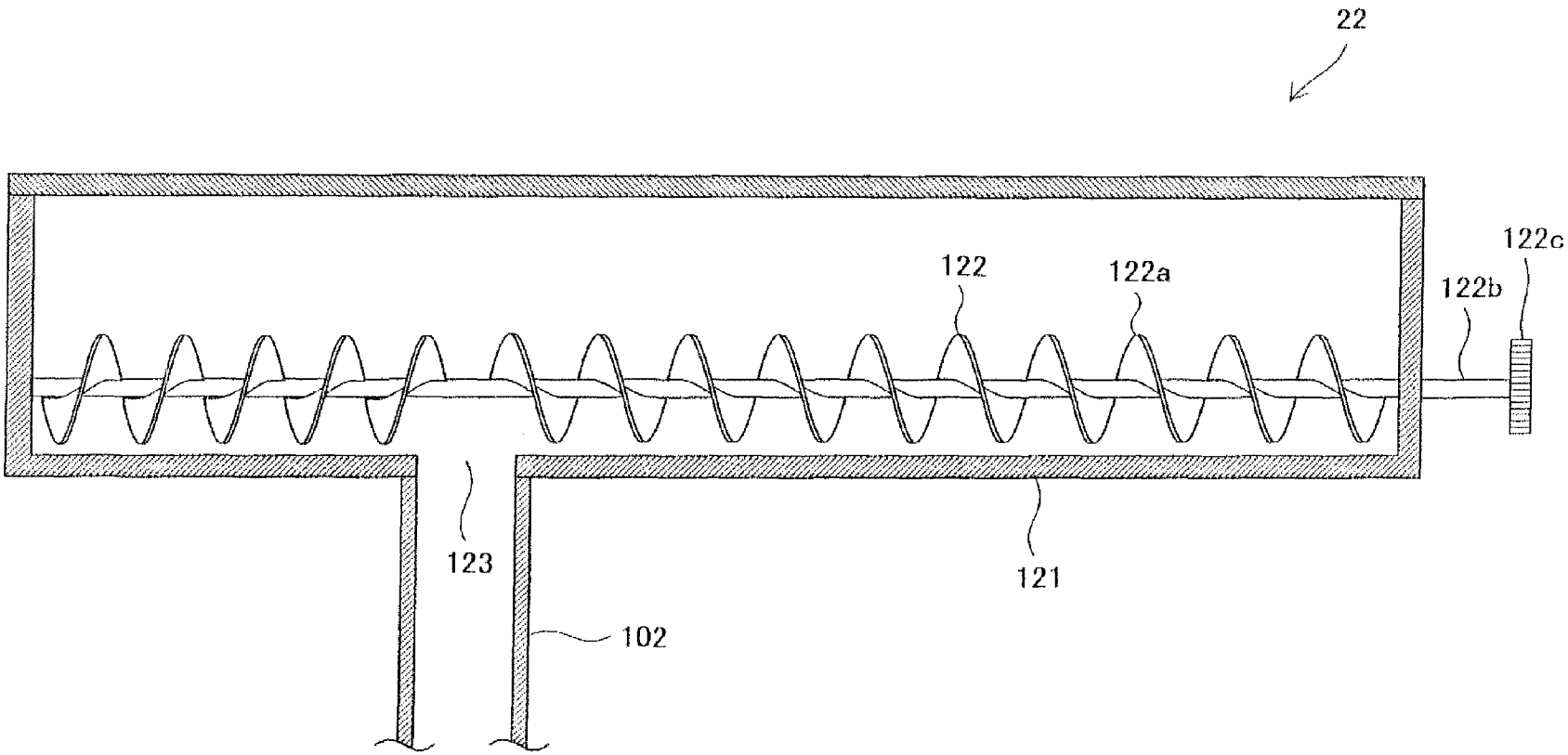
FIG. 3 is a sectional view cut along a plane C1-C2 in FIG. 2.

FIG. 2 is a sectional view showing the schematic configuration of the toner supply device that constitutes the image forming apparatus according to the present embodiment. FIG. 3 is a sectional view cut along a plane C1-C2 in FIG. 2.

As shown in FIG. 2, toner supply device 22 includes a toner storing container 121, a toner agitator 125, a toner discharger 122 and a toner discharge port 123. Toner supply device 22 is arranged on the upper side of developing vessel 111 and stores unused toner (powder toner). The toner in toner supply device 22 is supplied from toner discharge port 123 to developing vessel 111 (FIG. 1) by means of toner transport mechanism 102 (FIG. 1) as toner discharger (discharging screw) 122 is rotated.

Toner storing container 121 is a container part having a substantially semicylindrical configuration with a hollow interior, rotationally supporting toner agitator 125 and toner discharger 122 to store toner. As shown in FIG. 3, toner discharge port 123 is a substantially rectangular opening disposed under toner discharger 122 and positioned near to the center with respect to the direction of the axis (the axial direction: longitudinal direction) of toner discharger 122 so as to oppose toner transport mechanism 102.

Toner agitator 125 is a plate-like part that rotates about a rotary axis 125*a* in the direction of arrow Z as shown in FIG. 2 and draws up and conveys the toner stored inside toner storing container 121 toward toner discharger 122 whilst agitating the toner. Toner agitator 125 has a toner scooping part 125*b* at either end and extended along rotary axis 125*a*. Toner scooping part 125*b* is formed of a polyethylene terephthalate (PET) sheet having flexibility and is attached to both ends parallel to rotary axis 125*a* of toner agitator 125.

Toner discharger 122 dispenses the toner in toner storing container 121 from toner discharge port 123 to developing vessel 111, and is formed of an auger screw of a toner conveyor blade 122*a* and a toner discharger rotary shaft 122*b* and a toner discharger rotating gear 122*c*, as shown in FIG. 3. Toner discharger 122 is rotationally driven by an unillustrated toner discharger drive motor. As to the helical direction of the auger screw, toner conveyor blade 122*a* is designed so that toner can be conveyed from both ends of toner discharger 122 toward toner discharge port 123 with respect to the axial direction of toner discharger rotational axis 122*b* Provided between toner discharger 122 and toner agitator 125 is a toner discharger partitioning wall 124. This wall makes it possible to keep and hold the toner scooped by toner agitator 125 in an appropriate amount around toner discharger 122.

As shown in FIG. 2, when toner agitator 125 agitates and scoop up the toner toward toner agitator 122 by its rotation in the direction of arrow Z, toner scooping parts 125*b* rotate as they are deforming and sliding over the interior wall of toner storing container 121 due to the flexibility thereof, to thereby supply the toner toward the toner discharger 122 side. Then, toner discharger 122 turns so as to lead the supplied toner to toner discharge port 123.

Next, developing device 2 will be described with reference to the drawings.

Figure 4:
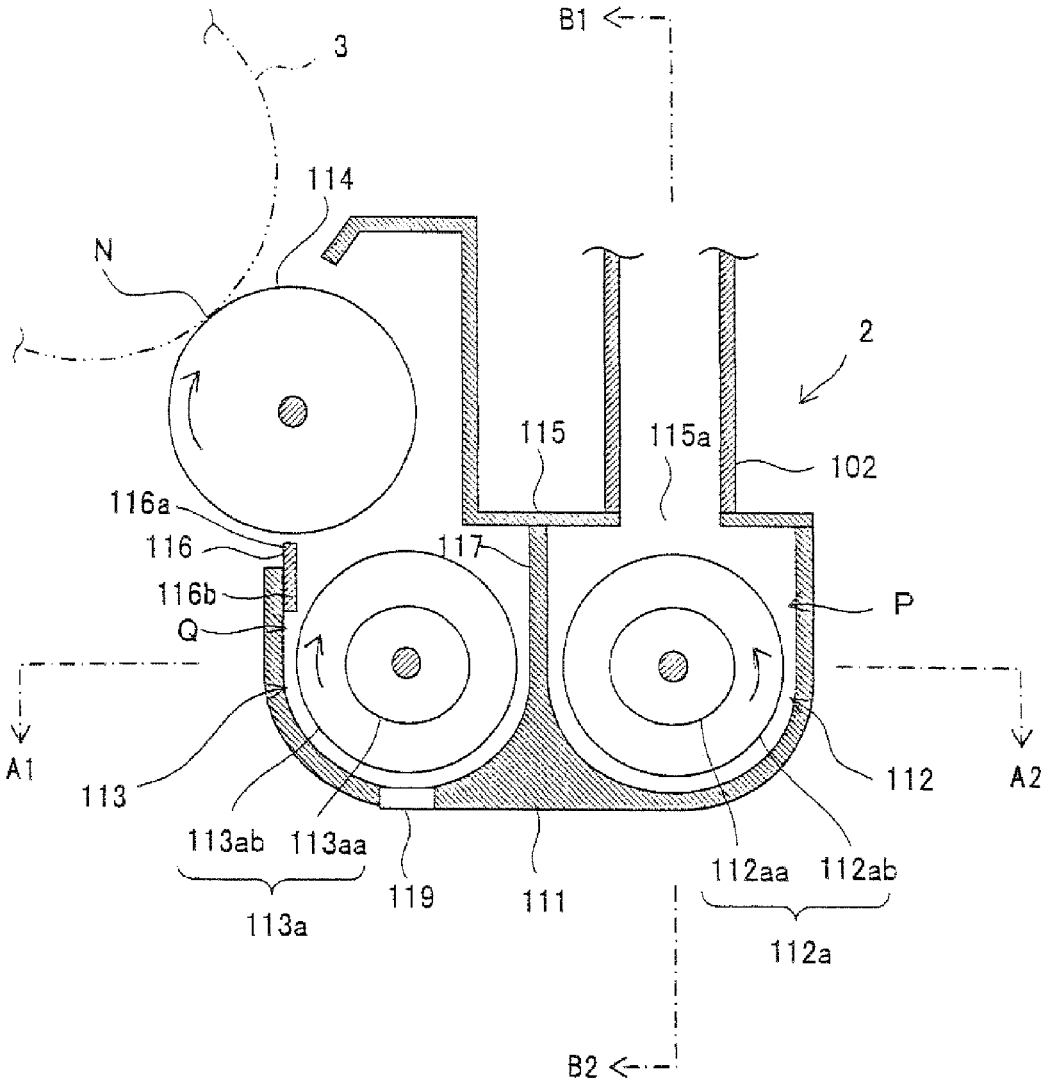
FIG. 4 is a sectional view showing the configuration of a developing device according to the first embodiment.
Figure 5:
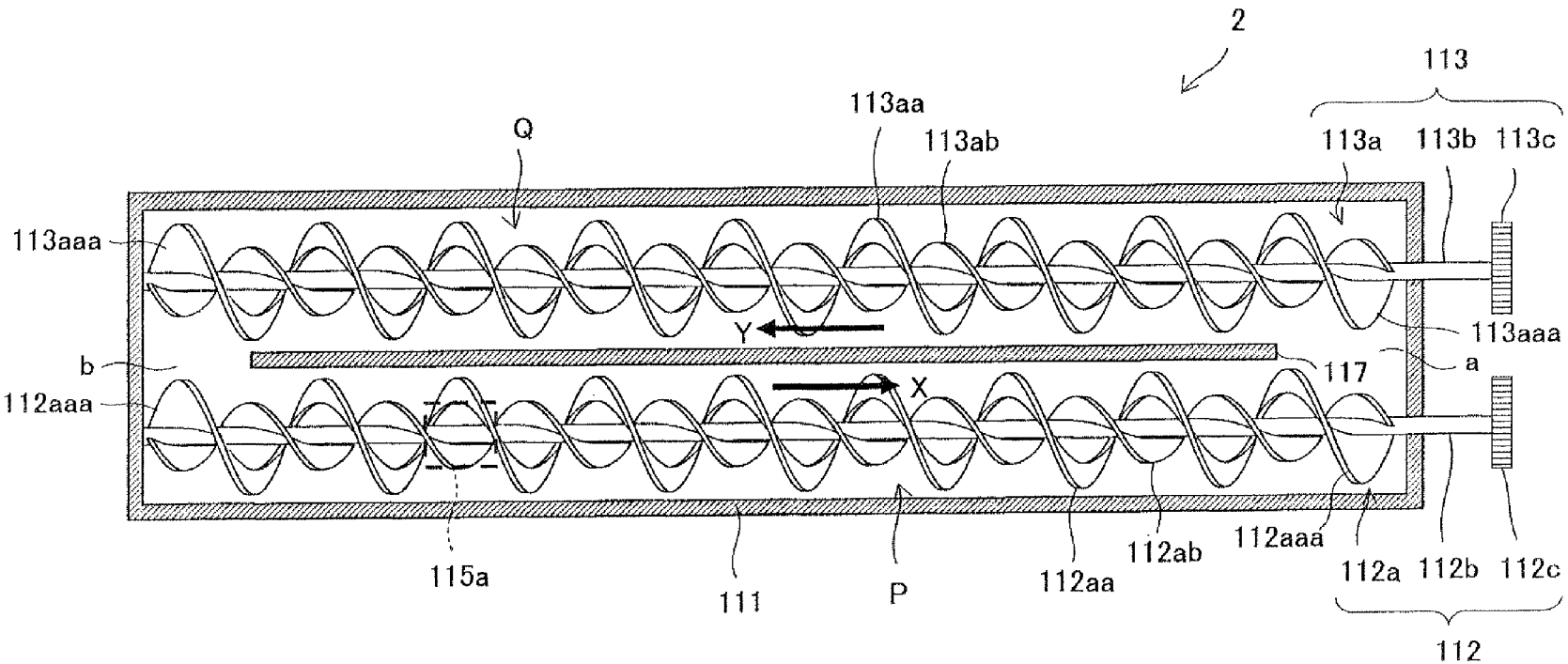
FIG. 5 is a sectional view cut along a plane A1-A2 in FIG. 4.
Figure 6:
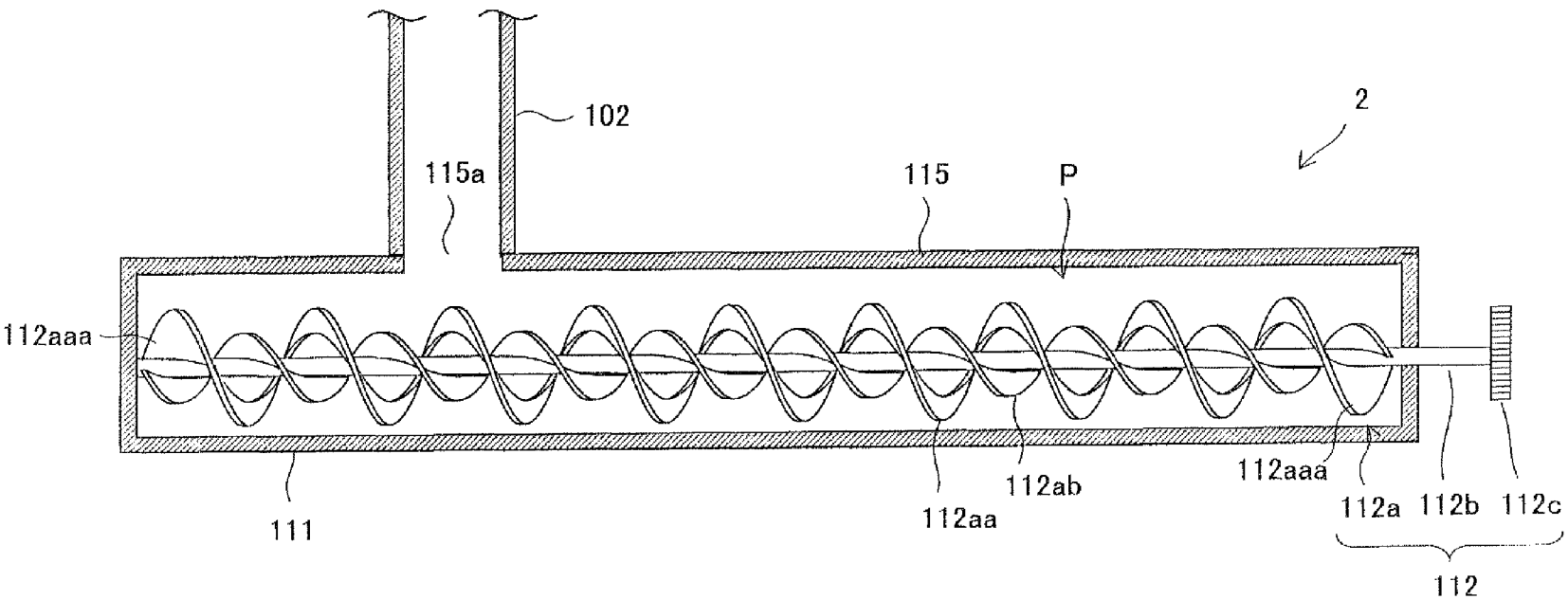
FIG. 6 is a sectional view cut along a plane B1-B2 in FIG. 4.

FIG. 4 is a sectional view showing the configuration of developing device 2, FIG. 5 is a sectional view cut along a plane A1-A2 in FIG. 4, and FIG. 6 is a sectional view cut along a plane B1-32 in FIG. 4.

As shown in FIG. 4, developing device 2 has a developing roller 114 arranged in developing vessel 111 so as to oppose photoreceptor drum 3 and supplies toner from developing roller 114 to the photoreceptor drum 3 surface to visualize (develop) the electrostatic latent image formed on the surface of photoreceptor drum 3.

Developing device 2, other than developing roller 114, further includes developing vessel 111, a developing vessel cover 115, a toner supply port 115*a*, a doctor blade 116, a first conveying member 112, a second conveying member 113, a partitioning plate (partitioning wall) 117 and a toner concentration detecting sensor (magnetic permeability detecting sensor) 119.

Developing vessel 111 is a container for holding a dual-component developer that comprises a toner and a carrier (which will be simply referred to hereinbelow as "developer"). Developing vessel 111 includes developing roller 114, first conveying member 112, second conveying member 113 and the like. Here, the carrier of the present embodiment is a magnetic carrier presenting magnetism.

Developing roller 114 is a rotating magnet roller which is rotationally driven about its axis by an unillustrated means, draws up and carries the developer in developing vessel 111 on the surface thereof and supplies toner from the developer supported on the surface thereof to photoreceptor drum 3.

Developing roller 114 is arranged parallel to, and away from, photoreceptor drum 3, so as to oppose photoreceptor drum 3. The developer conveyed by developing roller 114 comes in contact with photoreceptor drum 3 in the area where the roller surface and the drum surface become closest. This contact area is designated as a developing nip portion N. As a developing bias is applied to developing roller 114 from an unillustrated power source that is connected to developing roller 114, the toner included in the developer on the developing roller 114 surface is supplied at developing nip portion N to the electrostatic latent image on the photoreceptor drum 3 surface.

Arranged at a position close to the surface of developing roller 114 is a doctor blade 116. Doctor blade 116 is a rectangular plate-shaped member that is disposed parallel to the direction in which the axis of developing roller 114 is extended (axial direction). Doctor blade 116 is supported along its one longitudinal side 116*b* by a developing vessel cover 115 while the opposite longitudinal edge 116*a* is positioned a predetermined gap away from the developing roller 114 surface. This doctor blade 116 may be made of stainless steel, or may be formed of aluminum, synthetic resin or the like.

Toner concentration detecting sensor 119 is provided on the bottom of developing vessel 111, at a position vertically under second conveying member 113 in the approximate center with respect to the direction of the developer being conveyed, and attached with its sensor surface exposed to the interior of developing vessel 111. Toner concentration detecting sensor 119 is electrically connected to an unillustrated toner concentration controller. This toner concentration controller controls the associated components in accordance with the measurement of toner concentration detected by toner concentration detecting sensor 119 so as to supply toner from toner discharge port 123 into developing vessel 111, by rotationally driving toner discharger 122.

When the toner concentration controller determines that the measurement of toner concentration from toner concentration detecting sensor 119 is lower than the set toner concentration level, the controller sends a control signal to the driver for rotationally driving toner discharger 122, so as to rotationally drive toner discharger 122.

Toner concentration detecting sensor 119 may use general-purpose detection sensors. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. This power supply applies the drive voltage for driving the magnetic permeability detecting sensor and the control voltage for outputting the detected result of toner concentration to the controller. Application of voltage to magnetic permeability detecting sensor from the power supply is controlled by the controller. The magnetic permeability detecting sensor is a sensor that receives application of a control voltage and outputs the detected result of toner concentration as an output voltage. Since, basically, the sensor is sensitive in the middle range of the output voltage, the applied control voltage is adjusted so as to produce an output voltage around that range. Magnetic permeability detecting sensors of this kind are found on the market, examples including TS-L, TS-A and TS-K (all of these are trade names of products of TDK Corporation).

Arranged on the top of developing vessel 111 is removable developing vessel cover 115, as shown in FIG. 4. This developing vessel cover 115 is formed with toner supply port 115*a* for receiving unused toner into developing vessel 111.

Further, as shown in FIG. 1, the toner stored in toner supply device 22 is transported into developing vessel 111 through toner transport mechanism 102 and toner supply port 115*a*, and thereby supplied to developing vessel 111.

Arranged in developing vessel 111 is partitioning plate 117 between first conveying member 112 and second conveying member 113. Partitioning plate 117 is extended parallel to the axial direction (the direction in which each rotary axis is laid) of first and second conveying members 112 and 113. The interior of developing vessel 111 is divided by partitioning plate 117 into two sections, namely, a first conveying passage P with first conveying member 112 and a second conveying passage Q with second conveying member 113.

Partitioning plate 117 is arranged so that its ends, with respect to the axial direction of first and second conveying members 112 and 113, are spaced from respective interior wall surfaces of developing vessel 111 (FIG. 5). Hereby, developing vessel 111 has communicating paths that communicate between first conveying passage P and second conveying passage Q at around both axial ends of first and second conveying members 112 and 113. In the following description, as shown in FIG. 5, the communicating path formed on the downstream side with respect to the direction of arrow X is named first communicating path a and the communicating path formed on the downstream side with respect to the direction of arrow Y is named second communicating path b.

First conveying member 112 and second conveying member 113 are arranged so that their axes are parallel to each other with their peripheral sides opposing each other across partitioning plate 117, and rotated in opposite directions. That is, first conveying member 112 conveys the developer in the direction of arrow X while second conveying member 113 conveys the developer in the direction of arrow Y, which is the opposite to the direction of arrow X, as shown in FIG. 5.

As shown in FIGS. 5 and 6, toner supply port 115*a* is formed within first conveying passage P at a position downstream of second communicating path b with respect to the direction of arrow X. That is, toner is supplied into first conveying passage P at a position downstream of second communicating path b.

In developing vessel 111, first conveying member 112 and second conveying member 113 are rotationally driven by a drive means (not shown) such as a motor etc., to convey the developer.

More specifically, in first conveying passage P, the developer is agitated and conveyed in the direction of arrow X by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y by second conveying member 213 to reach second communicating path b. Then, the developer reaching second communicating path b is conveyed through second communicating path b to first conveying passage P.

That is, first conveying member 112 and second conveying member 113 agitate the developer while conveying it in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as moving toward photoreceptor drum 3.

In order to compensate for this consumption of toner, unused toner is supplied from toner supply port 115*a* into first conveying passage P. The supplied toner is agitated and mixed with the previously existing developer in the first conveying passage P.

Now, first conveying member 112 and second conveying member 113 will be described in detail with reference to the drawings.

As shown in FIG. 5, first conveying member 112 is composed of a helical auger screw formed of a helical first conveying blade (helical blade) 112*a* and a first rotary shaft 112*b*, and a first conveying gear 112*c*. First conveying member 112 is rotationally driven by a drive means (not shown) such as a motor etc., to agitate and convey the developer.

First conveying blade 112*a* is formed with double helical blades having a double helical structure made of a first large-diametric helical blade 112*aa* that has a ring-shaped form having a large diameter (outside diameter) when viewed from the axial direction and a first small-diametric helical blade 112*ab* having a small diameter. In the present embodiment, ring-shaped, first large-diametric helical blade 112*aa* is a helical blade defining a ring-shaped (donut-shaped) form having an inside diameter equal to the outside diameter of first small-diametric helical blade 112*ab* and is fixed at both ends thereof, namely 112*aaa*, 112*aaa*, to first rotary shaft 112*b*.

First large-diametric helical blade 112*aa* and first small-diametric helical blade 112*ab* are formed so as to have the same helical pitch. First large-diametric helical blade 112*aa* and first small-diametric helical blade 112*ab* are formed so as to have a phase difference of 180.degree. with each other. Here, the phase difference indicates the angle by which first large-diametric helical blade 112*aa* is rotated clockwise (with respect to the direction in which first conveying member 112 is viewed from the upstream side of the conveyance of the developer) about the axis of first rotary shaft 112*b* until the phase of the blade corresponds to that of first small-diametric helical blade 112*ab*.

The ratio of the diameter of first small-diametric helical blade 112*ab* (the second outside diameter) to the diameter of first large-diametric helical blade 112*aa* (the first outside diameter) is preferably specified to fall within the range of 0.4 to 0.6. In the present embodiment, the outside diameter of first small-diametric helical blade 112*ab* (the second diameter) is set to be 0.5 times of the outside diameter of first large-diametric helical blade 112*aa* (the first diameter).

Here, if the ratio of the diameter of first small-diametric helical blade 112*ab* to that of first large-diametric helical blade 112*aa* is less than 0.4, the conveyance performance is prone to be lowered. In contrast, when the diameter ratio exceeds 0.6, the agitation performance is prone to be spoiled.

As shown in FIG. 5, second conveying member 113 is composed of a helical auger screw formed of a helical second conveying blade 113*a* and a second rotary shaft 113*b*, and a second conveying gear 113*c*. Second conveying member 113 is rotationally driven by a drive means (not shown) such as a motor etc., to agitate and convey the developer.

Second conveying blade 113*a* is comprised of double helical blades having a double helical structure made of a second large-diametric helical blade 113*aa* that has a large-diametric ring-shaped form when viewed from the axial direction and a second small-diametric helical blade 113*ab* having a small diameter. In the present embodiment, ring-shaped, second large-diametric helical blade 113*aa* is a helical blade defining a ring-shaped (donut-shaped) form having an inside diameter equal to the outside diameter of second small-diametric helical blade 113*ab* and is fixed at both ends thereof, namely 113*aaa*, 113*aaa*, to second rotary shaft 113*b*.

Second large-diametric helical blade 113*aa* and second small-diametric helical blade 113*ab* are formed so as to have the same helical pitch. Second large-diametric helical blade 113*aa* and second small-diametric helical blade 113*ab* are formed so as to have a phase difference of 180.degree. with each other. Here, the phase difference indicates the angle by which second large-diametric helical blade 113*aa* is rotated clockwise (with respect to the direction in which second conveying member 113 is viewed from the upstream side of the conveyance of the developer) about the axis of second rotary shaft 113*b* until the phase of the blade corresponds to that of second small-diametric helical blade 113*ab*.

The ratio of the diameter of second small-diametric helical blade 113*ab* (the second outside diameter) to the diameter of second large-diametric helical blade 113*aa* (the second outside diameter) is preferably specified to fail within the range of 0.4 to 0.6. In the present embodiment, the outside diameter of second small-diametric helical blade 113*ab* (the second diameter) is set to be 0.5 times of the outside diameter of second large-diametric helical blade 113*aa* (the second diameter).

Here, if the ratio of the diameter of second small-diametric helical blade 113*ab* to that of second large-diametric helical blade 113*aa* is less than 0.4, the conveyance performance is prone to be lowered. In contrast, when the diameter ratio exceeds 0.6, the agitation performance is prone to be spoiled.

Next, the operation of developing device 2 at the time of conveying the developer will be described with reference to the drawings.

Figure 7:
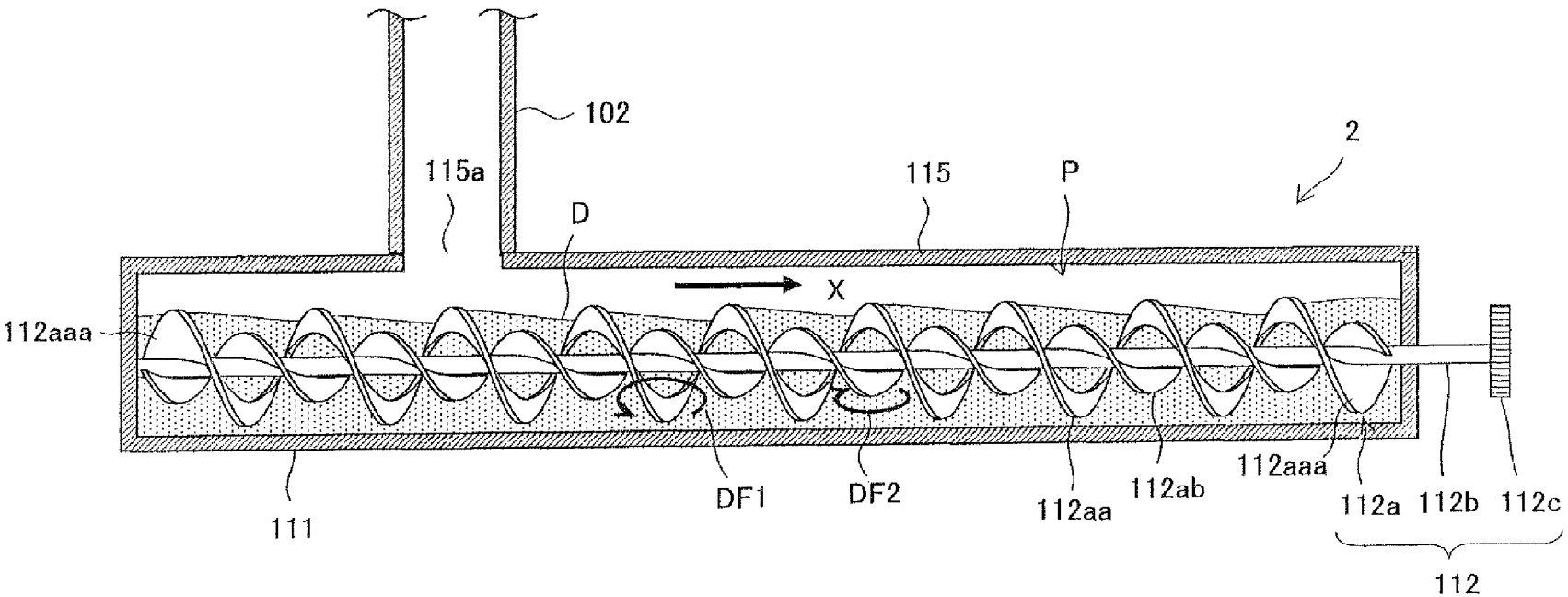
FIG. 7 is an illustrative view showing a state of the developer being conveyed by a first conveying member in the developing device.

FIG. 7 is an illustrative view showing the state of the developer being conveyed by first conveying member 112 in developing device 2 according to the present embodiment.

According to developing device 2 of the present embodiment, as shown in FIG. 5 the developer in developing vessel 111 is conveyed by first and second conveying members 112 and 113, in the direction of arrow X in first conveying passage P and in the direction of arrow Y in the second conveying passage Q.

The condition of developer D being agitated and conveyed by first and second conveying members 112 and 113 will be described taking the example of first conveying member 112.

As shown in FIG. 7, developer D is agitated and conveyed inside first conveying passage P by rotation of first conveying member 112. Developer D, as receiving force oriented in the direction of arrow X from first large-diametric helical blade 112*aa* and first small-diametric helical blade 112*ab*, is conveyed rightward in the drawing.

In this conveyance, in the vicinity of ring-shaped first large-diametric helical blade 112*aa*, developer D moves at higher speed around the area distant from first rotary shaft 112*b* (near the interior wall of developing vessel 111) and at lower speed around the area near first rotary shaft 112*b*. Further, in the vicinity of first small-diametric helical blade 112*ab*, developer D moves at lower speed around the area distant from first rotary shaft 112*b* (near the interior wall of developing vessel 111) and at higher speed around the area near first rotary shaft 112*b*. As a result, swirling flows DF1 and DF2 of developer D are locally created so as to promote agitation of developer D.

Further, since the diameter of first small-diametric helical blade 112*ab* is smaller than first large-diametric helical blade 112*aa*, developer D is agitated passing over first small-diametric helical blade 112*ab*, and this also promotes agitation effect of developer D.

In sum, according to first conveying member 112, agitation performance of developer D in first conveying passage P can be improved by both the agitation of the developer passing first small-diametric helical blade 112*ab*, and the agitation due to swirling flows DF1 and DF2, in the interval between first large-diametric helical blades 112*aa* and 112*aa*.

Heretofore, description was made taking the operational example of first conveying member 112 agitating and conveying developer D. Because second conveying member 113 has the same configuration as that of first conveying member 112, the performance of second conveying member 113 agitating developer D in second conveying passage Q can also be improved similarly to first conveying member 112.

According to the present embodiment having the configuration described above, since first conveying blade 112*a* having a double helical structure made of first large-diametric helical blade 112*aa* and first small-diametric helical blade 112*ab* is provided as first conveying member 112 and second conveying blade 113*a* having a double helical structure made of second large-diametric helical blade 113*aa* and second small-diametric helical blade 113*ab* is provided as second conveying member 113, it is possible to improve agitation performance of developer D in first and second conveying passages P and Q.

As a result, according to image forming apparatus 100 of the present embodiment, improvement of the agitation performance of developer D in developing device 2 eliminates occurrence of toner concentration unevenness, hence makes it possible to obtain images of stabilized image density.

Though the above embodiment was described taking an example in which developing device 2 of the technology is applied to image forming apparatus 100 shown in FIG. 1, as long as it is an image forming apparatus using developing device 2 in which the developer in developing vessel 111 is conveyed while being agitated by the developer conveying member, the technology can be developed to any other image forming apparatus and the like, not limited to the image forming apparatus and copier having the configuration described above.

Further, the first conveying blade and second conveying blade of the developing device is not limited to first conveying blade 112*a* and second conveying blade 113*a*. Other configurations of the first and second conveying blades will be described as the second and third embodiments hereinbelow.

In the second and third embodiments, components having the same configurations as in the first embodiment will be allotted with the same reference numerals and description on these is omitted. Further, the second and third embodiments will be described by focusing on the developing devices having first and second conveying blades which are different from those of the first embodiment.

The Second Embodiment

A developing device 2X according to the second embodiment will be described with reference to the drawings.

Figure 8:
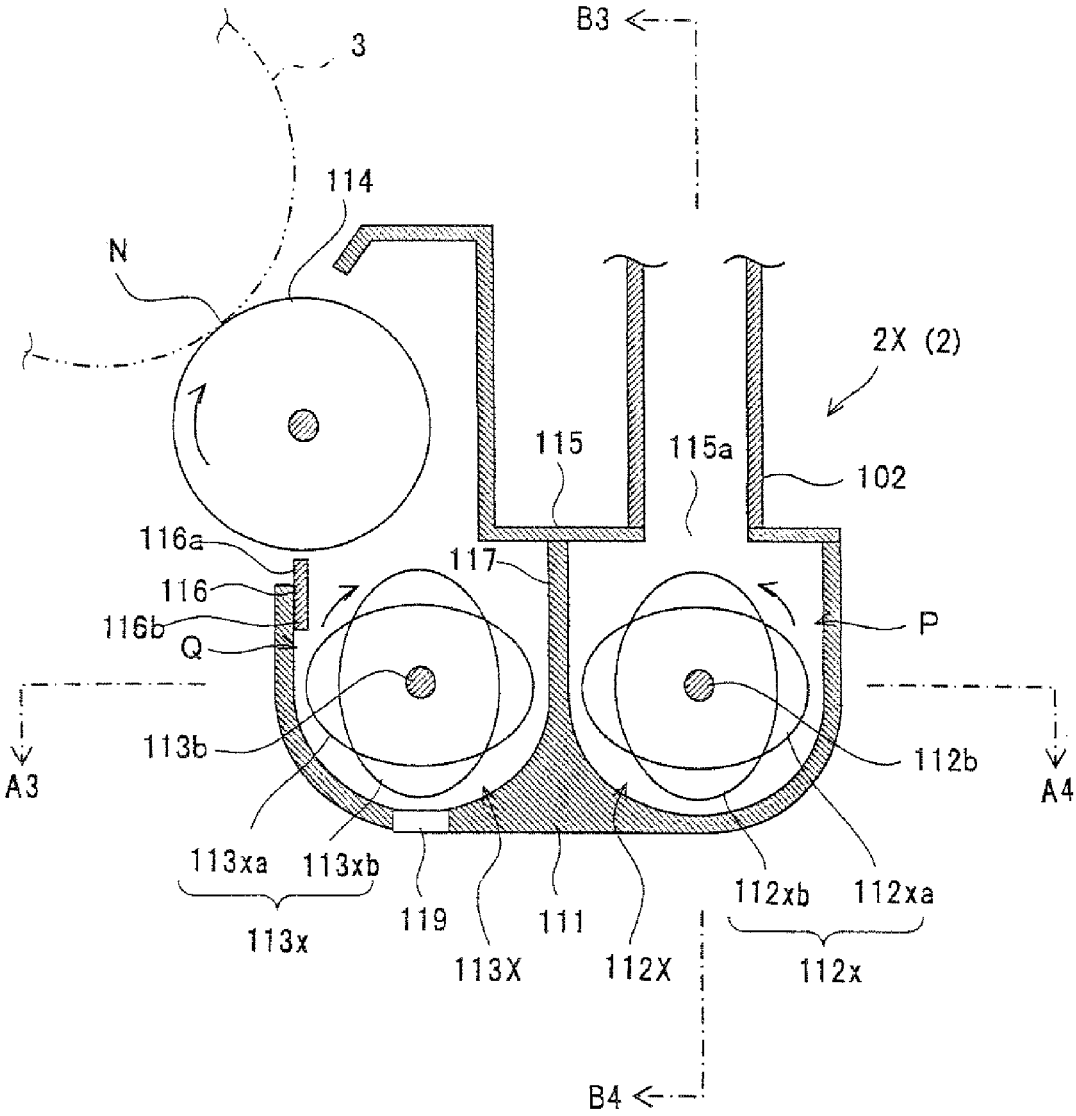
FIG. 8 is a sectional view showing the configuration of a developing device according to the second embodiment.
Figure 9:
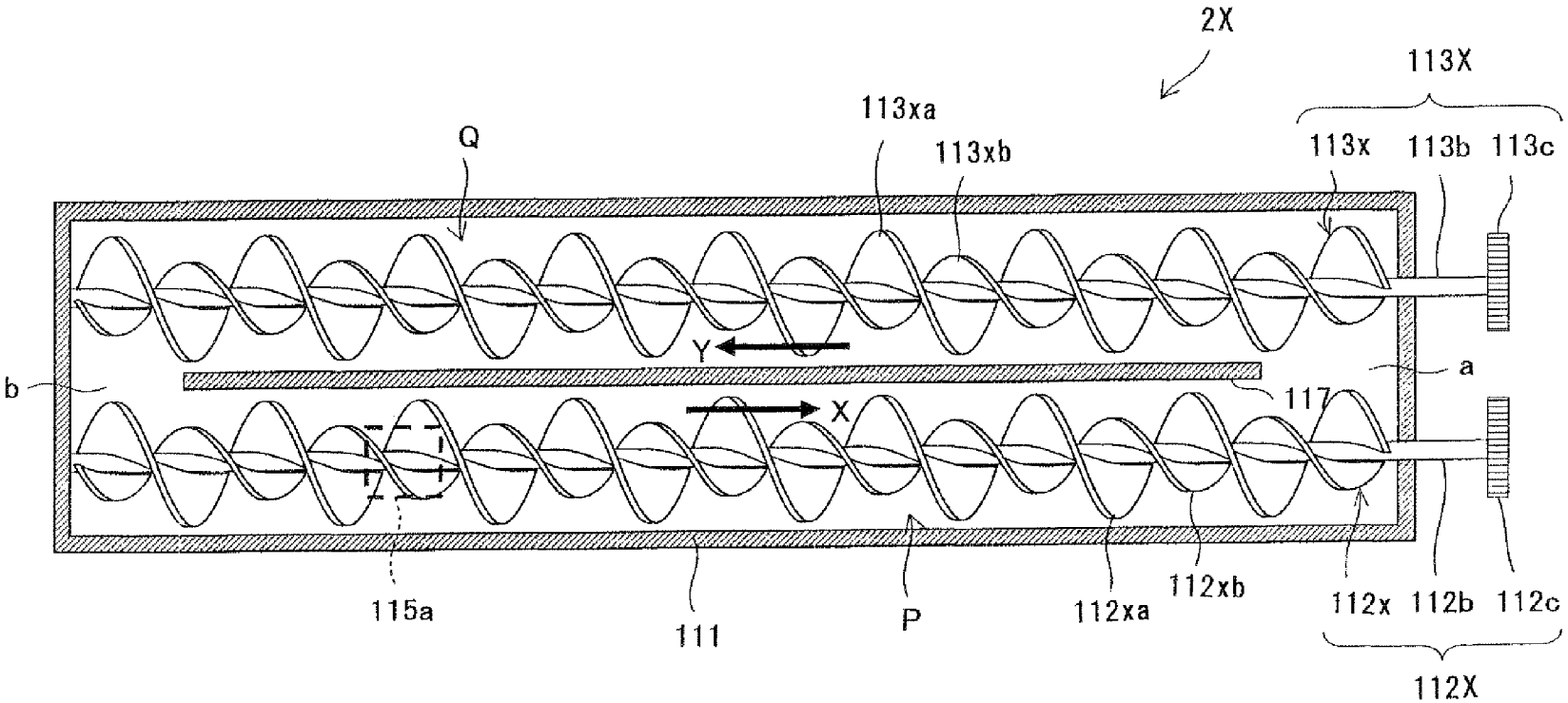
FIG. 9 is a sectional view cut along a plane A3-A4 in FIG. 8.
Figure 10:
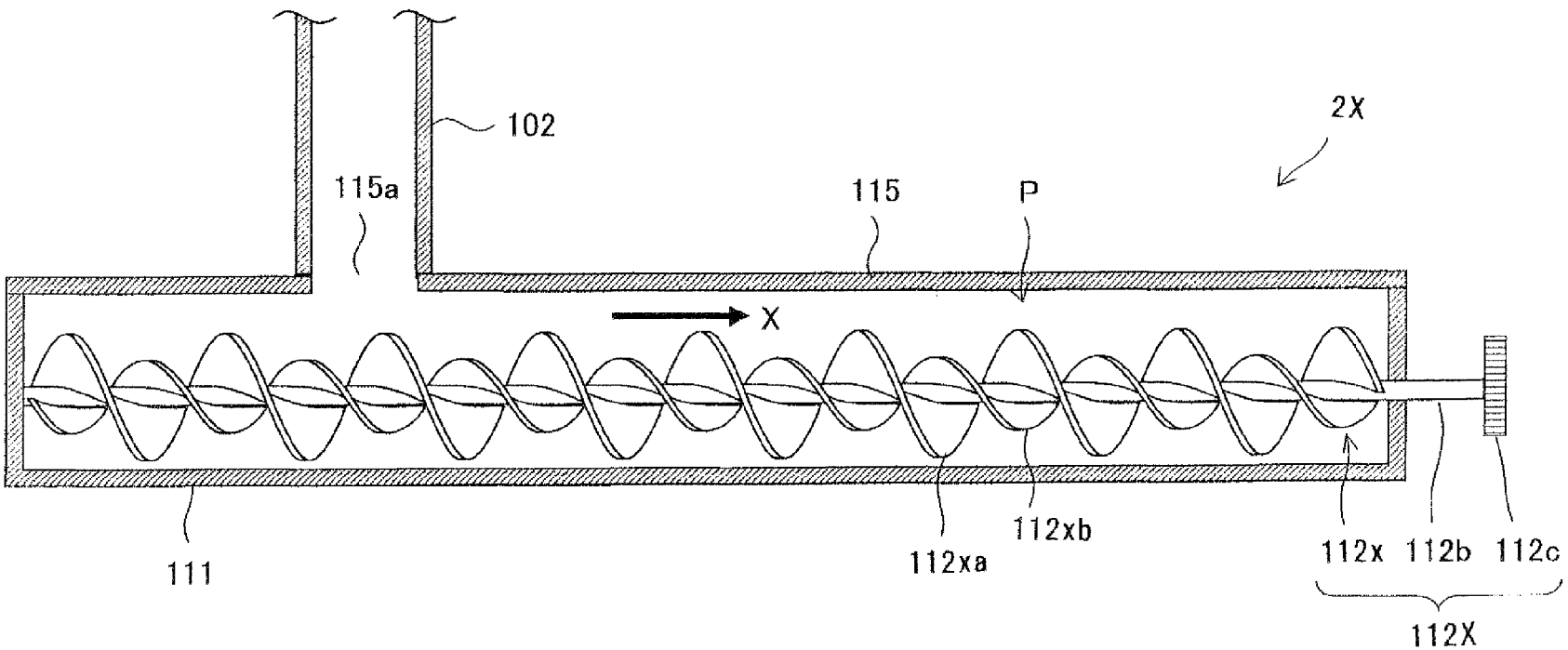
FIG. 10 is a sectional view cut along a plane 133-B4 in FIG. 8; and, FIG. 11 is a sectional view showing the configuration of a developing device according to the third embodiment.

FIG. 8 is a sectional view showing the configuration of developing device 2X, FIG. 9 is a sectional view cut along a plane A3-A4 in FIG. 8, and FIG. 10 is a sectional view cut along a plane B3-B4 in FIG. 8.

As shown in FIG. 8, developing device 2X has a developing roller 114 arranged in developing vessel 111 so as to oppose photoreceptor drum 3 and supplies toner from developing roller 114 to the photoreceptor drum 3 surface to visualize (develop) the electrostatic latent image formed on the surface of photoreceptor drum 3.

Developing device 2X, other than developing roller 114, further includes developing vessel 111, a developing vessel cover 115, a toner supply port 115*a*, a doctor blade 116, a first conveying member 112X, a second conveying member 113X, a partitioning plate 117 and a toner concentration detecting sensor 119.

As shown in FIG. 9, first conveying member 112X is composed of an auger screw formed of a first conveying blade 112X having a first A-phase helical blade 112*xa* of a helical form and a first B-phase helical blade 112*xb* of a helical form and a first rotary shaft 112*b*, and a first conveying gear 112*c*. First conveying member 112X is rotationally driven by a drive means (not shown) such as a motor, or other means to agitate and convey the developer.

First A-phase helical blade 112*xa* and first B-phase helical blade 112*xb* are formed in the same shape having the same helical pitch. First A-phase helical blade 112*xa* and first B-phase helical blade 112*xb* are formed on first rotary shaft 112*b* so as to have a phase difference of 180 degrees with each other.

Further, first A-phase helical blade 112*xa* and first B-phase helical blade 112*xb* are each formed so that the radius of the helical blade periodically varies in a rotational angular period of 180 degrees, forming an elliptic shape when viewed from the axial direction, as shown in FIG. 8.

The ratio of the minimum radius of each of first A-phase helical blade 112*xa* and first B-phase helical blade 112*xb* to the maximum radius is preferably specified to fall within the range of 0.4 (40%) to 0.6. (60%) In the present embodiment, the minimum radius of each of first A-phase helical blade 112*xa* and first B-phase helical blade 112*xb* is set to be 0.5 times (50%) of the maximum radius.

Here, if the ratio of the minimum radius of each of first A-phase helical blade 112*xa* and first B-phase helical blade 112*xb* to the maximum radius is less than 0.4, the conveyance performance is prone to be lowered. In contrast, when the radius ratio exceeds 0.6, the agitation performance is prone to be spoiled.

Here, in first conveying member 112X, the radius of the helical blade indicates the distance from the center of first rotary shaft 112*b* to the leading edge (outer periphery) of the helical blade extending in the radial direction of first rotary shaft 112*b*.

Further, the rotational angular period indicates the central angle when the axis of first rotary shaft 112*b* is designated to be the center of the circle.

Also, the phase difference indicates the angle by which first A-phase helical blade 112*xa* is rotated clockwise (with respect to the direction in which first conveying member 112X is viewed from the upstream side of the conveyance of the developer) about the axis of first rotary shaft 112*b* until the phase of the blade corresponds to that of first B-phase helical blade 112*xb*.

As shown in FIG. 9, second conveying member 113X is composed of an auger screw formed of a second conveying blade 113X having a second A-phase helical blade 113*xa* of a helical form and a second B-phase helical blade 113*xb* of a helical form and a second rotary shaft 113*b*, and a second conveying gear 113*c*. Second conveying member 113X is rotationally driven by a drive means (not shown) such as a motor, or other means to agitate and convey the developer.

Second A-phase helical blade 113*xa* and second B-phase helical blade 113*xb* are formed in the same shape having the same helical pitch. Second A-phase helical blade 113*xa* and second B-phase helical blade 113*xb* are formed on second rotary shaft 113*b* so as to have a phase difference of 180 degrees with each other.

Further, second A-phase helical blade 113*xa* and second B-phase helical blade 113*xb* are each formed so that the radius of the helical blade periodically varies in a rotational angular period of 180 degrees, forming an elliptic shape when viewed from the axial direction, as shown in FIG. 8.

The ratio of the minimum radius of each of second A-phase helical blade 113*xa* and second B-phase helical blade 113*xb* to the maximum radius is preferably specified to fall within the range of 0.4 to 0.6. In the present embodiment, the minimum radius of each of second A-phase helical blade 113*xa* and second B-phase helical blade 113*xb* is set to be 0.5 times of the maximum radius.

Here, if the ratio of the minimum radius of each of second A-phase helical blade 113*xa* and second B-phase helical blade 113*xb* to the maximum radius is less than 0.4, the conveyance performance is prone to be lowered. In contrast, when the radius ratio exceeds 0.6, the agitation performance is prone to be spoiled.

Here, in second conveying member 113X, the radius of the helical blade indicates the distance from the center of second rotary shaft 113*b* to the leading edge (outer periphery) of the helical blade extending in the radial direction of second rotary shaft 113*b*.

Further, the rotational angular period indicates the central angle when the axis of second rotary shaft 113*b* is designated to be the center of the circle.

Also, the phase difference indicates the angle by which second A-phase helical blade 113*xa* is rotated clockwise (with respect to the direction in which second conveying member 113X is viewed from the upstream side of the conveyance of the developer) about the axis of second rotary shaft 113*b* until the phase of the blade corresponds to that of second B-phase helical blade 113*xb*.

Next, the operation of developing device 2X at the time of conveying the developer will be described with reference to the drawings.

According to developing device 2X of the second embodiment, as shown in FIG. 9 the developer in developing vessel 111 is conveyed by first and second conveying members 112X and 113X, in the direction of arrow X in first conveying passage P and in the direction of arrow Y in the second conveying passage Q.

The condition of the developer being agitated and will be described taking the example of first conveying member 112X.

As shown in FIG. 10, the developer is conveyed inside first conveying passage P, rightward in the drawing, by rotation of first conveying member 112X, as receiving force oriented in the direction of arrow X from first A-phase helical blade 112*xa* and first B-phase helical blade 112*xb*.

Since first conveying blade 112X is formed of first A-phase helical blade 112*xa* and first B-phase helical blade 112*xb*, it is possible to make the interval between adjacent helical blades short so as to enlarge the surface area of the helical blade in contact with the developer (to reduce the amount of developer conveyed by the interval between adjacent helical blades). As a result, the force (pressure) of first A-phase helical blade 112*xa* and first B-phase helical blade 112*xb* acting on the developer can be reduced, it is hence possible to alleviate stress on the developer.

Further, first A-phase helical blade 112*xa* and first B-phase helical blade 112*xb* are each formed so that the radius of the helical blade periodically varies every rotational angle of 180'. That is, the outlines of first A-phase helical blade 112*xa* and first B-phase helical blade 112*xb* are formed in an elliptic shape, when viewed from the axial direction of first rotary shaft 112*b*, so that the developer can be moved (agitated) effectively in the developer's direction of conveyance, passing over the portions where the radius of the helical blade is short (small-diametric portions). It is hence possible to improve agitating effect of the developer with respect to the axial direction of first conveying member 112X. As a result, it is possible to reduce toner concentration unevenness.

Heretofore, description was made taking the operational example of first conveying member 112X agitating and conveying the developer. Because second conveying member 113X has the same configuration as first conveying member 112X, the performance of second conveying member 113X agitating developer D in second conveying passage Q can also be improved in the same manner as that of first conveying member 112X.

According to the second embodiment having the configuration described, above, since, in developing device 2X, provision of first A-phase helical blade 112*xa* and first B-phase helical blade 112*xb* having the above-described configurations as first conveying member 112X, and provision of second A-phase helical blade 113*xa* and second B-phase helical blade 113*xb* having the above-described configurations as second conveying member 113X, makes it possible to reduce the force acting on the developer by means of the two helical blades, it is possible to alleviate stress on the developer and effectively move (agitate) the developer in the developer's direction of conveyance. It is hence possible to improve agitating effect of the developer with respect to the axial directions of first and second conveying member 112X and 113X. As a result, it is possible to reduce toner density unevenness.

Accordingly, in image forming apparatus 100 of the second embodiment, improvement of the agitation performance of the developer in developing device 2X eliminates occurrence of toner concentration unevenness, hence makes it possible to obtain images of stabilized image density.

Though developing device 2X of the second embodiment present is a configuration in which two phase helical blades are provided on the rotary shaft, two or more phase helical blades may be provided on the rotary shaft. A developing device having three phase helical blades formed on the rotary shaft will be described as the third embodiment.

The Third Embodiment

Next, the third embodiment for carrying out the technology will be described with reference to the drawing.

Figure 11:
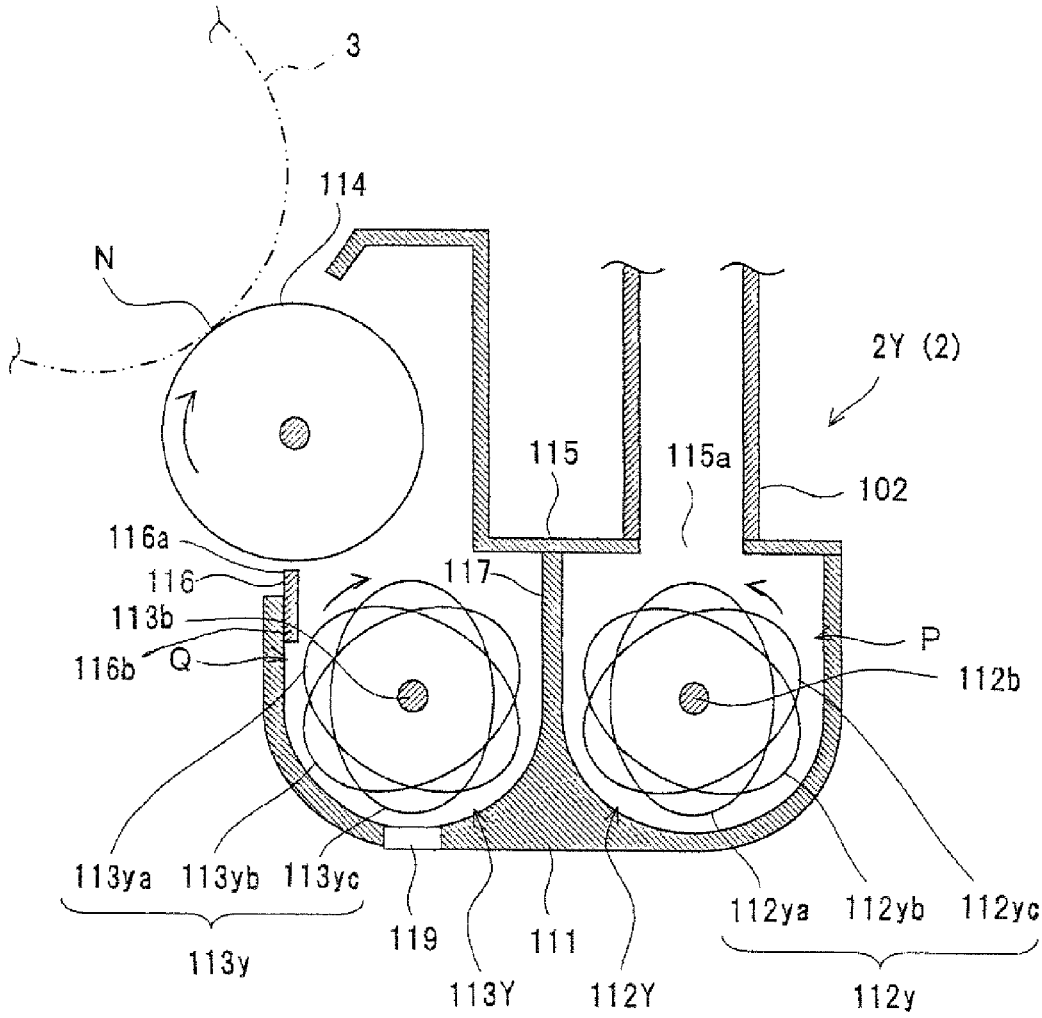

FIG. 11 is an illustrative view showing the configuration of a developing device 2Y according to the third embodiment.

Here, since the configuration of developing device 2Y includes the same components as those of developing devices 2 and 2X of the first and second embodiments except the first and second conveying members, the same components are allotted with the same reference numerals and description on those is omitted.

As shown in FIG. 11, developing device 2Y has a developing roller 114 arranged in developing vessel 111 so as to oppose photoreceptor drum 3 and supplies toner from developing roller 114 to the photoreceptor drum 3 surface to visualize (develop) the electrostatic latent image formed on the surface of photoreceptor drum 3.

Developing device 2Y, other than developing roller 114, further includes developing vessel 111, a developing vessel cover 115, a toner supply port 115*a*, a doctor blade 116, a first conveying member 112Y, a second conveying member 113Y, a partitioning plate 117 and a toner concentration detecting sensor 119.

As shown in FIG. 11, first conveying member 112Y is composed, of an auger screw formed of a first conveying blade 112*y* having a first A-phase helical blade 112*ya* of a helical form, a first B-phase helical blade 112*yb* of a helical form and a first C-phase helical blade 112*yc* of a helical form and a first rotary shaft 112*b*, and a first conveying gear (not shown). First conveying member 112Y is rotationally driven by a drive means (not shown) such as a motor, or other means to agitate and convey the developer.

First A-phase helical blade 112*ya*, first B-phase helical blade 112*yb* and first C-phase helical blade 112*yc* are formed in the same shape having the same helical pitch. First A-phase helical blade 112*ya*, first B-phase helical blade 112*yb* and first C-phase helical blade 112*yc* are formed on first rotary shaft 112*b* so as to have a phase difference of 120 degrees with each other.

The ratio of the minimum radius of each of first A-phase helical blade 112*ya*, first B-phase helical blade 112*yb* and first C-phase helical blade 112*yc* to the maximum radius is preferably specified to fall within the range of 0.4 to 0.6. In the present embodiment, the minimum radius of each of first A-phase helical blade 112*ya*, first B-phase helical blade 112*yb* and first C-phase helical blade 112*yc* is set to be 0.5 times of the maximum radius.

Here, if the ratio of the minimum radius of each of first A-phase helical blade 112*ya*, first B-phase helical blade 112*yb* and first C-phase helical blade 112*yc* to the maximum radius is less than 0.4, the conveyance performance is prone to be lowered. In contrast, when the radius ratio exceeds 0.6, the agitation performance is prone to be spoiled.

Herein, in first conveying member 112Y, the radius of the helical blade indicates the distance from the center of first rotary shaft 112*b* to the leading edge (outer periphery) of the helical blade extending in the radial direction of first rotary shaft 112*b*.

Also, the phase difference indicates the angle by which first A-phase helical blade 112*ya* is rotated clockwise (with respect to the direction in which first conveying member 112Y is viewed from the upstream side of the conveyance of the developer) about the axis of first rotary shaft 112*b* until the phase of the blade corresponds to that of first B-phase helical blade 112*yb*, and the angle by which first B-phase helical blade 112*yb* is rotated clockwise until the phase of the blade corresponds to that of first C-phase helical blade 112*yc*.

As shown in FIG. 11, second conveying member 113Y is composed of an auger screw formed of a second conveying blade 113*y* having a second A-phase helical blade 113*ya* of a helical form, a second B-phase helical blade 113*yb* of a helical form and a second C-phase helical blade 113*yc* of a helical form and a second rotary shaft 113*b*, and a second conveying gear (not shown). Second conveying member 113Y is rotationally driven by a drive means (not shown) such as a motor, or other means to agitate and convey the developer.

Second A-phase helical blade 113*ya*, second B-phase helical blade 113*yb* and second C-phase helical blade 113*yc* are formed in the same shape having the same helical pitch. Second A-phase helical blade 113*a*, second B-phase helical blade 113*yb* and second C-phase helical blade 113*yc* are formed on second rotary shaft 113*b* so as to have a phase difference of 120 degrees with each other.

The ratio of the minimum radius of each of second A-phase helical blade 113*ya*, second B-phase helical blade 113*yb* and second C-phase helical blade 113*ye* to the maximum radius is preferably specified to fall within the range of 0.4 to 0.6. In the present embodiment, the minimum radius of each of second A-phase helical blade 113*ya*, second B-phase helical blade 113*yb* and second C-phase helical blade 113*yc* is set to be 0.5 times of the maximum radius.

Here, if the ratio of the minimum radius of each of second A-phase helical blade 113*ya*, second B-phase helical blade 113*yb* and second C-phase helical blade 113*ye* to the maximum radius is less than 0.4, the conveyance performance is prone to be lowered. In contrast, when the radius ratio exceeds 0.6, the agitation performance is prone to be spoiled.

Herein, in second conveying member 113Y, the radius of the helical blade indicates the distance from the center of second rotary shaft 113*b* to the leading edge (outer periphery) of the helical blade extending in the radial direction of second rotary shaft 113*b*.

Also, the phase difference indicates the angle by which second A-phase helical blade 113*ya* is rotated clockwise (with respect to the direction in which second conveying member 113Y is viewed from the upstream side of the conveyance of the developer) about the axis of second rotary shaft 113*b* until the phase of the blade corresponds to that of second B-phase helical blade 113*yb*, and the angle by which second. B-phase helical blade 113*yb* is rotated clockwise until the phase of the blade corresponds to that of second C-phase helical blade 113*yc*.

Next, the operation of developing device 2Y at the time of conveying the developer will be described with reference to the drawings.

According to developing device 2Y of the third embodiment, similarly to the second embodiment shown in FIG. 9, the developer in developing vessel 111 is conveyed by first and second conveying members 112Y and 113Y, in the direction of arrow X in first conveying passage P and in the direction of arrow Y in the second conveying passage Q.

The condition of the developer being agitated and conveyed by first and second conveying members 112Y and 113Y will be described taking the example of first conveying member 112Y.

The developer is conveyed inside first conveying passage P, rightward in the drawing, by rotation of first conveying member 112Y, as receiving force oriented in the direction of arrow X from first A-phase helical blade 112*ya*, first B-phase helical blade 112*yb* and first C-phase helical blade 112*yc*.

Since first conveying blade 112Y is formed of first A-phase helical blade 112*ya*, first B-phase helical blade 112*yb* and first C-phase helical blade 112*yc*, it is possible to make the interval between adjacent helical blades short so as to enlarge the surface area of the helical blade in contact with the developer. As a result, the force (pressure) of first A-phase helical blade 112*ya*, first B-phase helical blade 112*yb* and first C-phase helical blade 112*yc* acting on the developer can be reduced, it is hence possible to alleviate stress on the developer.

Further, first A-phase helical blade 112*ya*, first B-phase helical blade 112*yb* and first C-phase helical blade 112*yc* are each formed so that the radius of the helical blade periodically varies every rotational angle of 180.degree. That is, the outlines of first A-phase helical blade 112*ya*, first B-phase helical blade 112*yb* and first C-phase helical blade 112*yc* are formed in an elliptic shape, when viewed from the axial direction of first rotary shaft 112*b*, so that the developer can be moved (agitated) effectively in the developer's direction of conveyance, passing over the portions where the radius of the helical blade is short (small-diametric portions). It is hence possible to improve agitating effect of the developer with respect to the axial direction of first conveying member 112Y. As a result, it is possible to reduce toner density unevenness.

Heretofore, description was made taking the operational example of first conveying member 112Y agitating and conveying the developer. Because second conveying member 113Y has the same configuration as first conveying member 112Y, the performance of second conveying member 113Y agitating developer D in second conveying passage Q can also be improved in the same manner as that of first conveying member 112Y.

According to the third embodiment having the configuration described above, the effect as follows can be obtained in addition to the effect obtained by the second embodiment. That is, since, in developing device 2Y, provision of first A-phase helical blade 112*ya*, first B-phase helical blade 112*yb* and first C-phase helical blade 112*yc* having the above-described configurations as first conveying member 112Y, and provision of second A-phase helical blade 113*ya*, second B-phase helical blade 113*yb* and second C-phase helical blade 113*yc* having the above-described configurations as second conveying member 113Y, makes it possible to further reduce the force acting on the developer by means of the three helical blades, it is possible to alleviate stress on the developer and effectively move (agitate) the developer in the developer's direction of conveyance. It is hence possible to improve agitating effect of the developer with respect to the axial directions of first and second conveying member 112Y and 113Y. As a result, it is possible to reduce toner density unevenness.

Though the above embodiments were described taking examples in which developing devices 2, 2X and 2Y are applied to image forming apparatus 100 shown in FIG. 1, as long as it is an image forming apparatus using developing device 2, 2X or 2Y in which the developer in developing vessel 111 is conveyed while being agitated by the developer conveying members, the technology can be developed to any other image forming apparatus and the like, not limited to the image forming apparatus and copier having the configuration described above.

Having described heretofore, the technology is not limited to the above embodiments, various changes can be made within the scope of the appended claims. That is, any embodied mode obtained by combination of technical means modified as appropriate without departing from the spirit and scope of the technology should be included in the technical art.

What is claimed is:

1. A developing device comprising:

a developer container for accommodating a developer comprising a toner and a magnetic carrier;

a developer conveying passage through which the developer is conveyed in the developer container;

a developer conveying member disposed inside the developer conveying passage for agitating and conveying the developer in a predetermined direction; and, a developing roller which bears the developer in the developer conveying passage and supplies the toner contained in the developer to a photoreceptor drum, characterized in that the developer conveying member includes:

a rotary shaft, and multi helical blades formed on a periphery of the rotary shaft, the multi helical blades include one or more ring-shaped helical blades and one or more small-diametric helical blades, the small-diametric helical blade has a second outside diameter smaller than a first outside diameter of the ring-shaped helical blade, a helical pitch of the ring-shaped helical blade is the same as a helical pitch of the small-diametric helical blade, and the ring-shaped helical blade and the small-diametric helical blade have the same twist direction.

2. The developing device according to claim 1, wherein the multi helical blades form a double helical structure including two blades, one being the ring-shaped helical blade and the other the small-diametric helical blade.

3. The developing device according to claim 1, wherein the second outside diameter is set to fall within the range of 0.4 times to 0.6 times of the first outside diameter.

4. The developing device according to claim 1, wherein the ring-shaped helical blade and the small-diametric helical blade are arranged so as to have a phase difference of 180 degrees with each other.

5. An image forming apparatus for forming images with toner based on electrophotography, comprising:

a photoreceptor drum for forming an electrostatic latent image on the surface thereof;

a charging device for electrifying the surface of the photoreceptor drum;

an exposure device for forming the electrostatic latent image on the photoreceptor drum surface;

a developing device for forming a toner image by supplying toner to the electrostatic latent image on the photoreceptor drum surface;

a transfer device for transferring the toner image to a recording medium; and, a fixing device for fixing the transferred toner image to the recording medium, characterized in that the developing device employs the developing device defined in claim 1.

6. A developing device comprising:

a developer container for accommodating a developer comprising a toner and a magnetic carrier;

a developer conveying passage through which the developer is conveyed in the developer container;

a developer conveying member disposed inside the developer conveying passage for agitating and conveying the developer in a predetermined direction; and, a developing roller which bears the developer in the developer conveying passage and supplies the toner contained in the developer to a photoreceptor drum, characterized in that the developer conveying member is an auger screw including a rotary shaft and a plurality of helical blades formed on the periphery of the rotary shaft, and each of the helical blades has a radius that periodically varies along the length of the blade.

7. The developing device according to claim 6, wherein the plural helical blades all have the same helical pitch.

8. The developing device according to claim 7, wherein the plural helical blades comprise two helical blades, the two helical blades are each formed so that the radius periodically varies along the length of the blade on a cycle of the rotational angle of 180 degrees, and, the two helical blades are formed so as to have a phase difference of 90 degrees.

9. The developing device according to claim 7, wherein the plural helical blades comprise three helical blades, the three helical blades are each formed so that the radius periodically varies along the length of the blade on a cycle of the rotational angle of 180 degrees, and, the three helical blades are formed so as to have a phase difference of 60 degrees from each other.

10. The developing device according to claim 6, wherein the helical blades are formed so that a minimum radius falls within the range of 40% to 60% of a maximum radius.

11. An image forming apparatus for forming images with toner based on electrophotography, comprising:

a photoreceptor drum for forming an electrostatic latent image on the surface thereof;

a charging device for electrifying the surface of the photoreceptor drum;

an exposure device for forming the electrostatic latent image on the photoreceptor drum surface;

a developing device for forming a toner image by supplying toner to the electrostatic latent image on the photoreceptor drum surface;

a transfer device for transferring the toner image to a recording medium; and, a fixing device for fixing the transferred toner image to the recording medium, characterized in that the developing device employs the developing device defined in claim 6.

* * * * *